United States Patent [19]

Griffin et al.

[11] 4,001,982

[45] Jan. 11, 1977

[54] CUTTING TIP RESEATER

[75] Inventors: Robert K. Griffin; Birch A. Ober, both of Sparks, Nev.

[73] Assignee: Sierra Tool Company, Sparks, Nev.

[22] Filed: July 23, 1975

[21] Appl. No.: 598,464

[52] U.S. Cl. ..... 51/211 R

[51] Int. Cl.[2] ..... B24D 15/00

[58] Field of Search ..... 51/204, 211 R, 214; 144/28.1, 28.11

[56] References Cited

UNITED STATES PATENTS 905,638 12/1908 VonBeust ..... 51/211 R

FOREIGN PATENTS OR APPLICATIONS 647,100 12/1950 United Kingdom ..... 144/28.11

*Primary Examiner*—Al Lawrence Smith
*Assistant Examiner*—James G. Smith
*Attorney, Agent, or Firm*—Townsend and Townsend

[57] ABSTRACT

Apparatus for reseating the two or more sealing surfaces of a cutting tool tip is disclosed. The sealing surfaces of such a cutting tool tip are conformed to a common conical shape. The apparatus of the present invention includes a support member which has a conical interior cavity conformed to the common conical shape of the sealing surfaces. A slit is provided in the support member which communicates with the cavity so that a sheet of emery paper can be inserted through the slit to circumscribe and conform to the interior surface of the cavity. As a result, a damaged cutting tool tip can be inserted in the cavity with the sealing surfaces thereof flush with the emery paper and rotated to reseat the seaing surfaces in the common conical shape.

5 Claims, 4 Drawing Figures

CUTTING TIP RESEATER

BACKGROUND OF THE INVENTION

The present invention relates to apparatus for reseating the sealing surfaces of the cutting tool tip which are conformed to a common conical shape.

In cutting tools which employ two gases which ignite when combined, such as oxygen and acetylene, the gasses are usually fed separately to a cutting tool tip. The gasses are mixed in the cutting tool tip and the mixture expelled and ignited to provide a cutting flame. It has been found advantageous in such devices to provide the cutting tool tip with two or more sealing surfaces conformed to a common conical shape which mate with complementary surfaces on the cutting tool proper. One of the gasses is fed to the tip along its centerline, and the other gas is fed to the tip in the annular space between the two sealing surfaces. In some tools a third gas mixture is also fed to the tip in a second, outer annulus requiring a third sealing surface. Thus, the sealing surfaces not only confine the gasses so that they do not escape into the atmosphere, but also isolate the gasses one from the other.

When a cutting tool is being operated, the tip is quite often removed for cleaning or changing. When the tip is removed, it is dropped or knocked against a solid object, and the sealing surfaces can become damaged. If the sealing surfaces are not accurately reseated in their common conical shape, the gasses may intermix prematurely and explode and the use of such a damaged cutting tool tip thus presents a hazard to the user of the cutting tool. However, it has heretofore been difficult to accurately reseat the sealing surfaces of a cutting tool, and in particular to reseat the surfaces in their original common conical shape. Because of the danger involved using a damaged cutting tool tip, and the difficulty in repairing it accurately, such damaged tips are ordinarily discarded and a new tip used.

SUMMARY OF THE INVENTION

The present invention provides apparatus for reseating the two or more sealing surfaces of a cutting tool tip. The sealing surfaces of such a cutting tool tip are conformed to a common conical shape. The apparatus of the present invention includes a support member which has a conical interior cavity conformed to the common conical shape of the sealing surfaces. A slit is provided in the support member which communicates with the cavity so that a sheet of emery paper can be inserted through the slit to circumscribe and conform to the interior surface of the cavity. As a result, a damaged cutting tool tip can be inserted in the cavity with the sealing surfaces thereof flush with the emery paper and rotated to reseat the sealing surfaces in the common conical shape.

The primary advantage of the present invention is that the two or more sealing surfaces of a cutting tool tip can be accurately and consistently reseated in a single operation. Not only are the individual sealing surfaces reseated, but the surfaces together are reseated in conformance with their original common conical configuration. As a result, damaged cutting tool tips can be easily repaired and reused, saving the cost of new tool tips and substantially reducing the danger to the user of the cutting tool.

The above invention will be better understood by way of reference to the accompanying drawings in which a preferred embodiment thereof is illustrated by way of example.

DESCRIPTION OF THE PREFERRED EMBODIMENT

Figure 1:
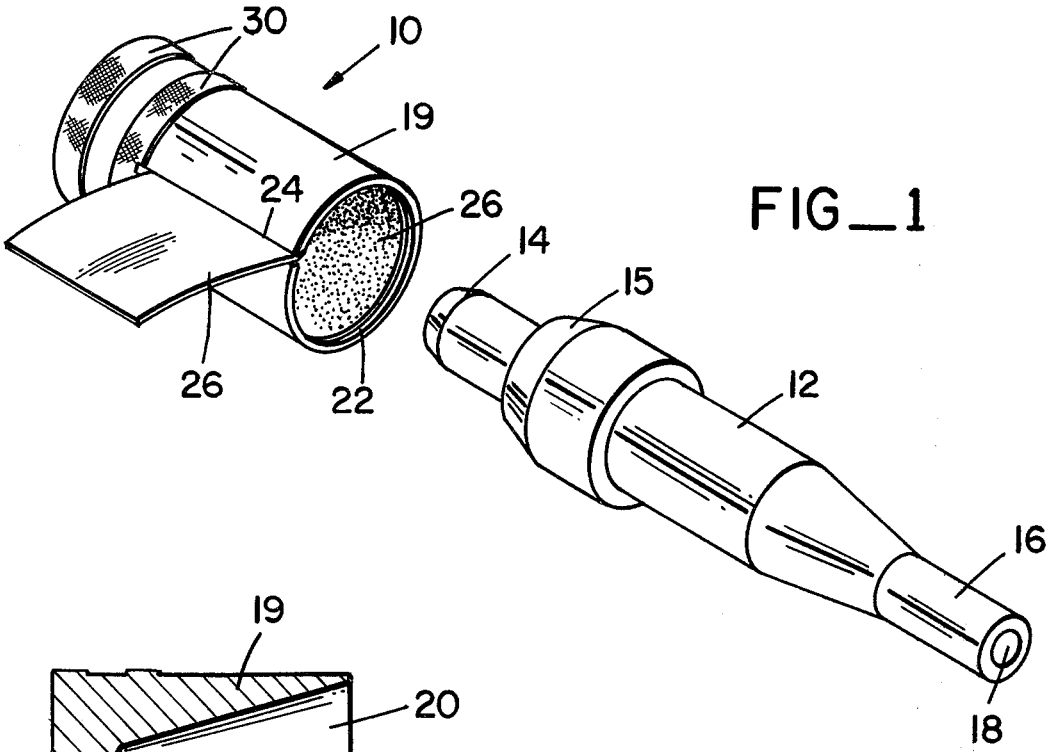
FIG. 1 is a perspective view of a cutting tool tip about to be inserted in the reseating apparatus of the present invention.

The use of the reseating apparatus 10 of the present invention in repairing a cutting tool tip 12 is illustrated by way of reference to FIG. 1. Cutting tool tip 12 is of the type which has a pair of sealing surfaces 14, 15 conformed to a common conical configuration. Sealing surfaces 14, 15 are adapted to mate with complementary surfaces on a cutting tool. The cutting tool feeds two combustible gasses to tip 12, one along the centerline of the tip and another in the annular space between sealing surfaces 14, 15. The sealing surfaces isolate the two combustible gasses one from the other and prevent them from escaping into the atmosphere. The two gasses are mixed within cutting tool tip 12 and expelled at the leading end 16 thereof through a single orifice 18 to provide fuel for a cutting flame.

Figure 2:
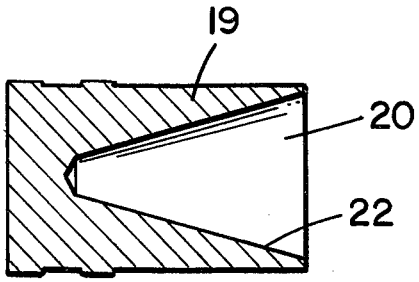
FIG. 2 is a cross sectional view of the reseating apparatus with the emery paper removed.

The reseating apparatus 10 includes a support member 19 which has an interior cavity 20, as better illustrated in FIG. 2. The interior surface 22 of cavity 20 is in the shape of a partially truncated cone. The conical portion of surface 22 is conformed to the common conical configuration of sealing surfaces 14, 15.

Figure 4:
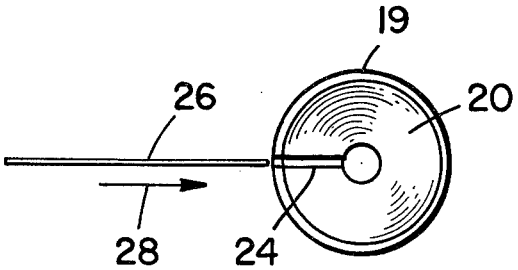
FIG. 4 is an end view of the reseating apparatus illustrating the insertion of the emery paper therein.

A planar slit 24 is provided in the sidewall of support member 19, and intersects and communicates with interior cavity 20. As a result, a piece of emery paper 26 can be inserted through planar slit 24 as illustrated by arrow 28 in FIG. 4 until the emery paper circumscribes the interior surface 22 of the cavity, as illustrated in FIG. 1. To facilitate insertion of emery paper 26, slit 24 may be inclined so that it is tangent to surface 22, or may be curved to bend the emery paper.

Figure 3:
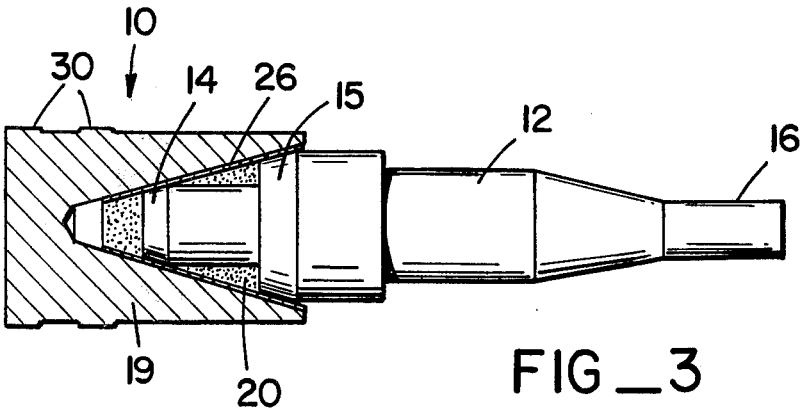
FIG. 3 is a cross sectional view of the reseating apparatus with the emery paper inserted and the cutting tool tip in place for reseating thereof.

After insertion of emery paper 26 in the cavity 20 of support member 19, cutting tool tip 12 can be engaged with reseating apparatus 10 as illustrated in FIG. 3. Sealing surfaces 14, 15 are moved into contact with the emery paper 26 within support member 19. Support member 19 can then be grasped at its outer knurled surface 30 and rotated relative to cutting tool tip 12 to reseat sealing surfaces 14, 15 in their original common conical configuration.

In operation, it is apparent that reseating apparatus 10 can be conveniently used to reseat the sealing surfaces 14, 15 of a cutting tool tip 12 when they become damaged. Thus, the cutting tool tip can be repaired and reused and need not be discarded, and does not present a hazard to the user of the cutting tool tip. Reseating apparatus 10 can be reused periodically until emery paper 26 becomes worn, at which time the worn emery paper can be removed and new emery paper inserted for further use of the apparatus.

While a preferred embodiment of the present invention has been illustrated in detail, it is apparent that modifications and adaptations of the embodiment will occur to those skilled in the art. However, it is to be expressly understood that such modifications and adaptations are within the spirit and scope of the present invention, as set forth in the following claims.

What we claim as new is:

1. Apparatus for reseating the two or more sealing surfaces of a cutting tool tip which are conformed to a common conical shape, said apparatus comprising a support member having an interior cavity, the interior surface of said cavity at least partially having a conical shape conformed to the common conical shape of the sealing surfaces, said support member further having a slit communicating with the cavity so that the slit intersects the conical shape of the interior surface, and a sheet of emery paper inserted through the slit to circumscribe and conform to the interior surface to the cavity whereby the cutting tool tip can be inserted in the cavity with the sealing surfaces thereof flush with the emery paper and the support member rotated relative to the cutting tool tip to reseat the sealing surfaces in said common conical shape.

2. Apparatus as recited in claim 1 wherein the support member has a cylindrical exterior surface coaxial with the interior conical shape.

3. Apparatus as recited in claim 2 wherein at least a portion of the cylindrical surface of knurled to facilitate turning of said support member.

4. Apparatus as recited in claim 1 wherein the slit comprises a planar slit.

5. A cutting tool tip system which comprises a cutting tool tip having at least two sealing surfaces conformed to a common conical slope for attachment of the tip to a cutting tool with the sealing surfaces thereof in abutment with complementary surfaces on the cutting tool to isolate and confine the flow of two combustible gasses to said tip, means for reseating the sealing surfaces of the cutting tool tip comprising a cylindrical support member having an interior cavity, the interior surface of said cavity at least partially having a conical shape coaxial with said cylindrical support member and conformed to the common conical shape of the sealing surfaces, said support member further having a substantially planar slit communicating with the cavity and a sheet of emery paper inserted through the slit to circumscribe and conform to the interior surface of the cavity and a knurled exterior portion so that the cutting tool tip can be inserted in the cavity with the sealing surfaces thereof flush with the emery paper and the support member rotated relative to the cutting tool tip to reseat the sealing surfaces in said common conical shape.

* * * * *